United States Patent [19]
Eckert
[11] 4,141,786
[45] Feb. 27, 1979

[54] MANGANIC ION DELIGNIFICATION OF LIGNOCELLULOSIC MATERIAL

[75] Inventor: Robert C. Eckert, Warwick, N.Y.

[73] Assignee: International Paper Company, New York, N.Y.

[21] Appl. No.: 844,553

[22] Filed: Oct. 25, 1977

Related U.S. Application Data

[63] Continuation of Ser. No. 722,957.

[51] Int. Cl.[2] ..... D21C 9/10

[52] U.S. Cl. ..... 162/40; 162/65; 162/76; 162/79; 162/82; 162/85; 162/86; 162/89; 162/90

[58] Field of Search ..... 162/37, 40, 60, 63, 162/65, 70, 76, 79, 80, 81, 82, 84, 85, 86, 88, 89, 90; 8/109, 110, 111, 156

[56] References Cited

U.S. PATENT DOCUMENTS

| | | | |
|---|---|---|---|
| 321,452 | 7/1885 | Pond | 162/65 X |
| 1,163,438 | 12/1915 | Muller | 162/65 X |
| 1,717,799 | 6/1929 | Marr | 162/79 X |
| 1,795,757 | 3/1931 | Bradley et al. | 162/79 |
| 1,860,432 | 5/1932 | Richter | 162/65 |
| 2,811,518 | 10/1957 | Mitchell et al. | 162/65 X |
| 3,061,504 | 10/1962 | Mutton | 162/65 |
| 3,382,276 | 5/1968 | Schenck et al. | 162/65 |
| 3,384,533 | 5/1968 | Robert et al. | 162/65 |
| 3,652,388 | 3/1972 | Croon et al. | 162/65 |
| 3,701,712 | 10/1972 | Samuelson et al. | 162/65 |
| 3,716,447 | 2/1973 | Aung et al. | 162/65 |
| 3,736,224 | 5/1973 | Grayson et al. | 162/65 |
| 3,769,152 | 10/1973 | Samuelson et al. | 162/65 |
| 3,790,637 | 2/1974 | Yang | 162/65 |
| 4,087,318 | 5/1978 | Samuelson et al. | 162/79 X |

FOREIGN PATENT DOCUMENTS

| | | | |
|---|---|---|---|
| 49503 | 1/1974 | Japan | 162/65 |
| 5094201 | 7/1975 | Japan | 162/65 |

OTHER PUBLICATIONS

Landucci et al., "Influence of Transition Metals In Oxygen Pulping", TAPPI 58(2); 11-1974; pp. 60-63; 162-165.

Minor et al., Journal of Polymer Science, "Oxygen-/Alkali Oxidation of Cellulose & Model Alcohols & The Inhibition by Iodide"; Part C, No. 36; (1971), pp. 73-84.

Landucci et al., (I) "The Influence of Metal & Iodide Ions in Oxygen Pulping of Southern Pine", 4th Canadian Wood Chemistry Symposium, Quebec (1973); pp. 71-74.

Ericsson et al., "Factors Influencing the Carbohydrate Degradation Under Oxygen-Alkali Bleaching," Svensk Papperstiding 74(22), 1971, pp. 757-765.

Myburgh, "Operation of the Enstra Oxygen Bleaching Plant", TAPPI, 57(5), pp. 131-133 (1974).

Abrahamsson et al., "Oxygen-Alkali Cooking of Wood Meal", Part V, Sensk Papperstiding, No. 4, pp. 135-140 (1975).

Abrahamsson et al. (I), "Oxygen-Alkali Cooking of Wood Meal", Part 7, Svensk Papperstiding, No. 9, pp. 281-285, 1976.

Gilbert et al., "Mechanism of Magnesium Retardation of Cellulose Degradation During Oxygen Bleaching", TAPPI, 56(6), 12-72, pp. 95-99.

Minor et al., "Improved Oxygen Bleaching with Iodide & Metal Ions", International Pulp & Bleaching Conference, Vancouver, B.C., 6-73, pp. 83-89.

*Primary Examiner*—Arthur L. Corbin

[57] ABSTRACT

A process for delignifying lignocellulosic pulps, which comprises the steps of (a) impregnating a lignocellulosic pulp slurry with a water-soluble manganous salt having a manganous ion concentration of from about 1% to about 10%, by weight of oven-dried pulp; (b) mixing the impregnated pulp slurry with an amount of alkali equal to the stoichiometric quantity of alkali required to precipitate the soluble manganous ion as insoluble manganous hydroxide; (c) aerating the pulp slurry with an oxygen-containing gas without further addition of alkali and in the absence of alkali for a period of time sufficient to oxidize substantially all of the manganous hydroxide to manganic hydroxide; (d) treating the pulp slurry with sufficient sulfuric acid to lower the slurry pH to at least about 3, thus releasing soluble manganic ions to oxidize the pulp lignins; (e) separating the effluent containing manganous ions from the pulp slurry with a non-alkaline wash; and then (f) extracting the oxidized lignins from the pulp slurry with an alkaline solution.

10 Claims, No Drawings

MANGANIC ION DELIGNIFICATION OF LIGNOCELLULOSIC MATERIAL

This is a continuation of application Ser. No. 722,957, filed Sep. 13, 1976, now abandoned.

BACKGROUND OF THE INVENTION

The present invention relates generally to a process for delignifying and bleaching lignocellulosic pulps and, more particularly, to a novel process for delignifying and bleaching chemical wood pulps with manganese.

It is known in the bleaching art that when lignocellulosic pulps are bleached with oxygen in an alkaline medium, the presence of manganese in catalytic amounts will confer certain benefits. For example, Minor and Landucci have reported (see International Pulp Bleaching Conference, 1973, Vancouver, B.C., pg. 83) that the rate of oxygen-alkali delignification of southern pine groundwood is accelerated by the addition of 0.01% manganese, but only a small effect was noted with a kraft pulp having a 7% lignin content. Gilbert et al. (TAPPI, 56(6), p. 95, 1973) found that while additions of only 10 ppm of manganese during oxygen-alkali bleaching of cotton linters resulted in viscosity losses, the use of increased amounts of manganese, i.e., 60 ppm, resulted in viscosity improvements.

Japanese Laid-Open Specification No. 49(74)-503 discloses that the presence of catalytic amounts of manganese, i.e., 0.2 weight percent, during oxygen bleaching inhibits carbohydrate degradation, as shown by improved strength properties. It also discloses that residual precipitated manganese compounds, which cause the pulp to have a pink coloration, can be removed by washing with dilute sulfuric acid.

It thus becomes apparent that the role of manganese, when employed in catalytic amounts in oxygen bleaching, is to react with the oxygen and alkali to form the insoluble compound, manganic hydroxide. Manganic hydroxide is not consumed stoichiometrically in reactions with lignin, but, rather, as a catalyst, it promotes or accelerates the reaction between oxygen and lignin, while also preventing excessive losses in viscosity.

As bleaching agents per se, manganese compounds have received little recognition. While Bradley et al., U.S. Pat. No. 1,795,757, discloses a bleaching system based on the use of manganate ion, +5, and permanganate ion, +7, which represent the two highest stable oxidation states of manganese, it must be used in conjunction with hypochlorite. Hypochlorite, being an extremely strong oxidant, contributes significantly to the bleaching potential and also facilitates the regeneration of $Mn^{+5}$ and $Mn^{+}7$. It also discloses an $SO_2$ or sulfurous acid wash after bleaching, but solely as a means of removing the manganese compounds from the fibers to avoid discoloration.

SUMMARY OF THE INVENTION

It has now been discovered that lignocellulosic pulps can be delignified to a significant extent by the direct action of manganese under acidic reaction conditions. The process, which is based upon the manganous ($Mn^{+2}$)/manganic ($Mn^{+3}$) redox couple, comprises the steps of: (a) impregnating a lignocellulosic pulp slurry with a water-soluble manganous salt having a manganous ion concentration of from about 1% to about 10% of manganese, by weight of oven-dried pulp; (b) mixing the impregnated pulp slurry with sufficient alkali to precipitate the soluble manganous ion as insoluble manganous hydroxide; (c) contacting the pulp slurry with an oxygen-containing gas for a period of time sufficient to oxidize substantially all the manganous hydroxide to manganic hydroxide; (d) treating the pulp slurry with sufficient acid to lower the slurry pH to at least about 3, thus releasing soluble manganic ions to oxidize the pulp lignin; (e) separating the effluent containing manganous ions from the slurry with a non-alkaline wash; and then (f) extracting the oxidized lignins from the pulp slurry with an alkaline solution.

There is thus provided a novel process by which acidified manganic hydroxide can extensively delignify unbleached chemical pulps, as well as oxygen bleached pulps, with the only constraint on the extent of delignification being the amount of manganese employed. Further, the manganous salts employed in the instant process may be readily and inexpensively regenerated and recycled for reuse. In addition, the process is compatible with the standard kraft recovery system, and is particularly well adapted for employment in conjunction with an oxygen-alkali bleaching system.

DETAILED DESCRIPTION OF THE INVENTION

In accordance with the process of the present invention, a slurry of unbleached lignocellulosic pulp fibers prepared by any of the chemical digestion processes, preferably by the kraft process, and having a consistency of from about 1% to about 30%, based on the weight of oven-dried pulp, is impregnated with a water-soluble salt of manganese having a concentration of from about 1% to about 10%, by weight of oven-dried pulp. The degree or extent of delignification will be stoichiometrically proportional to the amount of manganese employed. Exemplary of the manganese compounds which can be employed are: manganous sulfate, manganous chloride and manganous acetate.

The impregnated pulp is then mixed with sufficient alkali to precipitate the soluble manganous ions as manganous hydroxide, which is characterized by a pink coloration. Various alkalis can be used, representative of which are ammonia, alkali metal carbonates and hydroxides, such as sodium hydroxide, alkaline earth metal carbonates or hydroxides, or any other compound capable of releasing hydroxyl ions in aqueous solution. Sodium hydroxide is the preferred alkali, since it provides the greatest degree of compatibility with the standard recovery system. Sufficient alkali should be applied so as to equal or exceed the stoichiometric requirement for precipitating all of the manganese. If there is any excess alkali, it can be recovered for use in the caustic extraction stage.

Thereafter, the impregnated pulp slurry is oxygenated by exposing it to, and bringing it into contact with, an oxygen-containing gas, for example air or oxygen, at atmospheric pressure, or if desired, at superatmospheric pressure. The contact can be effected by simple mixing or by aerating the pulp with oxygen-containing gas, as by sparging. While elevated pressures are not necessary to the conduct of the process, it is, nevertheless, preferred to accomplish the oxygenation employing pressures ranging from about atmospheric to about 200 psig and at a temperature within the range from about 20° C. to about 150° C.

During the oxygenation, or aeration, stage, the manganous hydroxide is oxidized by molecular oxygen to manganic hydroxide. As the reaction proceeds, the pink color of manganous hydroxide changes to the dark brown color characteristic of manganic hydroxide. Manganous +2 is thereby elevated to a higher oxidation or electronic state, namely, manganic +3, which, when released in soluble form, will oxidize the lignin present in the pulp fibers.

Alternatively, a low- or high-consistency oxygen-/alkali bleaching stage may advantageously be substituted for the oxygenation, or aeration, stage. A suitable low-consistency oxygen/alkali bleaching stage for use in the instant process comprehends the use of a pulp having a consistency of from about 1% to about 10%, by weight of oven-dried pulp, an alkali content sufficient to elevate the pH of pulp slurry to between about 9 to about 14, conducted at a reaction temperature between about 70° C. and about 120° C. and at a pressure of from about 10 psig to about 200 psig. An especially suitable low-consistency oxygen bleaching process for use in this stage is disclosed in Roymoulik et al. U.S. Pat. No. 3,832,276.

A typical high-consistency oxygen bleaching stage involves the use of a pulp having a consistency of from about 15% to about 35%, by weight of oven-dried pulp, an alkali content calculated as sodium oxide of from about ½% to about 10%, by weight of oven-dried pulp, conducted at a reaction temperature of from about 70° C. to about 120° C. and at a pressure of from about 10 psig to about 200 psig.

As has been shown in the prior art, the presence of catalyic amounts of manganese compounds during the oxygen bleaching stage tends to accelerate the rate of delignification and inhibit carbohydrate degradation. The significantly greater amounts of manganese required for the present invention will, nonetheless, provide the same beneficial effects if an oxygen/alkali stage is substituted in the present process and, in addition, will result in still further delignification of the pulp, provided the catalyst is removed by proper acid post-treatment and alkali extraction.

In order to release the soluble manganic ion, the pulp mass is next acidified with a strong acid, either aqueous or gaseous, in an amount sufficient to dissolve the embedded manganic hydroxide precipitate. The acid employed must be capable of producing aqueous solutions of at least pH 3 or below, preferably a pH within the range of 1 to 2. This requires acids such as sulfuric, hydrochloric, nitric, phosphoric or sulfur trioxide in amounts stoichiometrically proportional to the amount of manganic hydroxide present in the pulp mass. From the standpoint of compatibility with the kraft recovery system, sulfuric acid is preferred. Easily oxidizable acids, such as sulfur dioxide, will dissolve the manganic hydroxide, but little lignin oxidation will occur because of the more facile reaction between manganic ion and sulfur dioxide.

It is interesting to note that when hydrochloric acid is employed as the acidifying agent, some of the acid would be oxidized by manganic ions to form chlorine. The chlorine will, of course, also react with the lignin, and therefore, acidification with hydrochloric acid results in a mixed system of manganic delignification and chlorination. In either case, in order to complete delignification, a caustic extraction stage must follow.

The concentration of acid in aqueous solution should be sufficiently high, for example pH 1 to 2, to dissolve the highly insoluble manganic hydroxide, but not in such an excess as to degrade the pulp polysaccharides severely. The acidification reaction can be carried out at temperatures ranging from 20° C. to 100° C., but the lower end of this range, namely, between 30° C. and 60° C. is preferred in order to avoid acid hydrolysis of carbohydrates. The time to complete the reaction depends on such variables as acid concentration, temperature and the amount of manganese applied and, thus, may range from about 10 minutes to about 3 hours. The end of the reaction is signalled by a complete disappearance of the dark brown color of the precipitated manganic hydroxide.

After acidification, the manganic ion is rapidly converted by reactions with lignin to the lower, stable oxidation state of manganous ion. The latter remains soluble as long as the acid stage effluent is neutral or acidic and is separated and removed with wash water from the pulp mass. The wash water should be non-alkaline to avoid reprecipitation of the manganous ion. The filtrate containing regenerated manganous ion may then be recycled for reuse with new incoming pulp. It should be emphasized that most of the manganese will be separated from the pulp by this washing step.

Although the fiber lignin has been oxidized, it is not rendered soluble until treated in a final stage with an alkaline solution, preferably a solution of sodium hydroxide. This stage is conducted as a caustic extraction stage in the usual manner, such as one similar to that following a conventional chlorination stage. For example, pulp at 3–20% consistency may be treated with 1–10% NaOH by weight of oven-dried pulp for 10–180 minutes at 20° C. to 100° C.

It is preferred that the effluent from the alkaline extraction stage be recycled to the manganese precipitation stage. By so doing, a closed loop is maintained and operating economies are effected. Alternatively, the caustic extraction filtrate can be recycled to provide partial makeup caustic to the oxygenation or oxygen bleaching stage. Another possible alternative for utilizing the filtrate from the caustic extraction stage, would be to recycle it to the normal kraft recovery system, in which case some manganese may be recovered in the green liquor dregs. If desired it may also be possible to reduce the amount of suspended manganese returning to recovery by retaining the extraction effluent in a settling tank.

In order to disclose more clearly the nature of the present invention, the following examples illustrating the invention are given. It should be understood, however, that this is done solely by way of example and is intended neither to delineate the scope of the invention nor limit the ambit of the appended claims. Permanganate numbers and viscosities were determined by standard Tappi procedures. All reported values are the average of two separate determinations.

EXAMPLE 1

This example illustrates the effects of direct manganic delignification of an unbleached softwood kraft pulp. The pulp used had an initial permanganate number of 14.1 (25 ml basis) and an initial viscosity of 27.6 cp.

The pulp was prepared for manganic ion bleaching by first adding 120 ml of a 0.751 M solution of manganous sulfate to 90 grams of oven-dried pulp, diluting it to 5% consistency, mixing for 30 minutes, adding 40 ml of 5N NaOH to precipitate manganous hydroxide, and aerating the pulp mass on a funnel for 1 hour. The pulp was then split into six separate 15 gram (O.D.) batches for individualized acid treatment.

As shown in Table I, acid treatments A-F were conducted at two levels of $H_2SO_4$ concentration, 1N and 2N, and three different temperatures, 22° C., 49° C., and 70° C. The other conditions were maintained constant, namely, 5.5% Mn on O.D. pulp, 10.0% consistency and 1 hour reaction time. Caustic extraction took place at 70° C. and 10% consistency using 4.0% NaOH on the pulp for 1 hour.

Table I

| Acid Treatment | A | B | C | D | E | F | G |
|---|---|---|---|---|---|---|---|
| Mn on Pulp, % Applied | 5.5 | 5.5 | 5.5 | 5.5 | 5.5 | 5.5 | 0 |
| Consistency, % | 10 | 10 | 10 | 10 | 10 | 10 | 10 |
| Sulfuric Acid on Pulp % | 80 | 80 | 80 | 40 | 40 | 40 | 80 |
| Temperature, ° C. | 22 | 49 | 70 | 22 | 49 | 70 | 70 |
| Reaction Time, Hours | 1 | 1 | 1 | 1 | 1 | 1 | 1 |
| NaOH on Pulp, % | 4 | 4 | 4 | 4 | 4 | 4 | 4 |
| P. No. (average of two) | 9.0 | 7.4 | 6.6 | 9.7 | 8.4 | 8.8 | 11.5 |
| Viscosity, cp. | 19.5 | 16.0 | 10.4 | 20.4 | 19.8 | 13.9 | 12.2 |

It is apparent from Table I, that control experiment G, which was conducted under the most severe conditions of acidity and temperature and in the absence of manganese, resulted in a substantial loss in viscosity with only minor delignification being effected.

By comparison, experiment C, which was conducted under the same severe conditions as the control, but in the presence of 5.5%, by weight, of manganese, also caused a loss in viscosity, but resulted in a 53% reduction in the permanganate number, which is indicative of extensive delignification. Under the less severe conditions employed in experiment E, the permanganate number was reduced 45%, while maintaining relatively good viscosity. It would appear that the losses in viscosity are more the consequence of acid hydrolysis, especially at elevated temperatures, rather than oxidative attack.

EXAMPLE 2

A 28 permanganate number (40 ml basis) and 38.4 cp viscosity softwood kraft pulp was used for experiments employing oxygen bleaching as a means of forming the manganic hydroxide. Pulp having a relatively high permanganate number was chosen in order to provide sufficient residual lignin for further manganic bleaching. In each experiment, 15.0 grams of O.D. pulp was used. A stirred Parr bomb was used as the oxygen bleaching reactor. The only variables in the oxygen stage were the amount of manganous sulfate added, namely, 0, 1.1 and 2.7% as manganese on O.D. pulp, and the sodium hydroxide concentration, namely, 1.0, 2.0 and 4.0 g/l. Otherwise, the oxygen bleaching conditions were maintained constant, i.e., 100° C., 100 psig $O_2$ injected at 100° C., 1.0% consistency, 40 minutes reaction time at 100° C. and continuous rapid mixing. When manganous sulfate was added to a bleach, a calculated excess of sodium hydroxide was also added to compensate for the removal of hydroxyl ions by precipitation as manganous hydroxide.

After oxygen bleaching, further processing involved one of the following standard treatments:

1. Washing with aqueous $SO_2$ at pH 2, for 30 minutes at 50° C. and 10% consistency; or 2. Washing with aqueous $H_2SO_4$, at pH 1–2 for 2 hours at 50° C. and 15% consistency, followed by caustic extraction with 4.0% NaOH on pulp for 1 hour at 70° C. and 10% consistency.

The sulfuric acid treatment was used to obtain further delignification from manganic hydroxide, in accordance with the present invention. Caustic extraction was performed to render the oxidized lignins soluble. Aqueous $SO_2$ was used to remove manganic hydroxide without causing further delignification, and thereby provide a set of control pulps. It should be noted that the $SO_2$ - washed pulps were not caustic extracted because separate trials showed very little permanganate number reduction from this added treatment.

Table II

Manganic Ion Bleaching Following Oxygen Bleaching

| Oxygen Bleach NaOH Conc. (g/l) | Manganese Applied, % on O.D. Pulp | $SO_2$ WASH P No. | $SO_2$ WASH Vis., cp | $H_2SO_4$ WASH + Caustic Extraction P No. | $H_2SO_4$ WASH + Caustic Extraction Vis., cp |
|---|---|---|---|---|---|
| | 0 | 15.4 | 21.3 | — | — |
| 1.0 | 1.1 | 14.7 | 22.7 | 12.7 | 20.7 |
| | 2.7 | 15.4 | 24.7 | 8.1 | 17.8 |
| | 0 | 12.3 | 19.4 | — | — |
| 2.0 | 1.1 | 10.8 | 19.5 | 8.7 | 16.1 |
| | 2.7 | 11.0 | 18.2 | 6.5 | 14.5 |
| | 0 | 9.6 | 14.6 | — | — |
| 4.0 | 1.1 | 9.3 | 18.7 | 7.8 | 15.7 |
| | 2.7 | 7.7 | 15.7 | 5.2 | 13.5 |

The data in Table II illustrate clearly that additional delignification can be achieved by subjecting oxygen-bleached pulps to the novel process of the present invention. The data also shows improvements in viscosity due to the presence of manganese during the oxygen-bleaching stage.

The unique aspects of the present process which make it advantageous compared to conventional bleaching technology are that the principal bleaching agent, manganic ion, is recyclable and regenerative, allowing maintenance of a closed loop around the bleaching process; that regeneration of the manganic ion can be accomplished by air oxidation at atmospheric pressure; that when sulfuric acid is used for acidification, the process effluents contain no chlorine chemicals and may be disposed of in conventional recovery systems; and that if manganese is used as a catalyst in oxygen bleaching, catalyst removal by acids such as sulfuric will provide even further delignification.

The terms and expressions which have been employed are used as terms of description and not of limitation, and there is no intention in the use of such terms and expressions of excluding any equivalents of the features shown and described or portions thereof, but it is recognized that various modifications are possible within the scope of the invention claimed.

What is claimed is:

1. A process for delignifying lignocellulosic pulps with manganic ion, which comprises the steps of:

(a) impregnating a lignocellulosic pulp slurry with a water-soluble manganous salt having a manganous ion concentration of from about 1% to about 10%, by weight of oven-dried pulp;

(b) mixing the impregnated pulp slurry with an amount of alkali equal to the stoichiometric quantity of alkali required to precipitate the soluble manganous ion as insoluble manganous hydroxide;

(c) aerating the pulp slurry with an oxygen-containing gas without further addition of alkali and in the absence of alkali for a period of time sufficient to oxidize substantially all of the manganous hydroxide to manganic hydroxide;

(d) acidifying the pulp slurry with sufficient sulfuric acid to lower the slurry pH to at least about 3 to release soluble manganic ions to oxidize the pulp lignins, said manganic ions being reduced to manganous ions by the pulp lignins and forming an effluent containing manganous ions;

(e) separating the effluent containing manganous ions from the pulp slurry with a non-alkaline wash; and then (f) extracting the oxidized lignins from the pulp slurry with an alkaline solution.

2. A process according to claim 1 wherein the pulp consistency is from about 1% to about 30%, by weight of oven-dried pulp.

3. A process according to claim 1 wherein the water-soluble manganous salt is selected from the group consisting of manganous sulfate, manganous chloride and manganous acetate.

4. A process according to claim 1 wherein the water-soluble manganous salt is manganous sulfate.

5. A process according to claim 1 wherein the alkali in step (b) is selected from the group consisting of ammonia, alkali metal carbonates and hydroxides, and alkaline earth metal carbonates and hydroxides.

6. A process according to claim 1 wherein the alkali in step (b) in sodium hydroxide.

7. A process according to claim 1 wherein the slurry pH in step (d) is lowered to about 1 to 2.

8. A process according to claim 1 wherein the effluent from step (e) is recycled to step (a).

9. A process according to claim 1 wherein the alkaline extraction of step (f) comprises extracting with from about 1% to about 10% sodium hydroxide, by weight of oven-dried pulp, at from about 20° C. to about 100° C., for about 10 minutes to about 180 minutes, at a pulp consistency of from about 3% to about 20%.

10. A process for delignifying lignocellulosic pulps with manganic ion, which comprises the steps of:

(a) impregnating a lignocellulosic pulp slurry having a consistency of from 1% to about 30%, by weight of oven-dried pulp, with manganous sulfate, said manganous sulfate having a manganous ion concentration of from about 1% to about 10%, by weight of oven-dried pulp;

(b) mixing the impregnated pulp slurry with an amount of sodium hydroxide equal to the stoichiometric quantity of sodium hydroxide required to precipitate the soluble manganous ion as insoluble manganous hydroxide;

(c) aerating the pulp slurry with an oxygen-containing gas without further addition of alkali and in the absence of alkali at a pressure of from about atmospheric to about 200 psig and at a temperature of from about 20° C. to about 150° C. for a period of time sufficient to oxidize substantially all of the maganous hydroxide to manganic hydroxide;

(d) acidifying the pulp slurry with an amount of sulfuric acid which is stoichiometrically proportional to the amount of manganic hydroxide present in the pulp slurry to lower the slurry pH to between about 1 to about 2 release soluble maganic ions to oxidize the pulp lignins, said manganic ions being reduced to manganous ions by the pulp lignins and forming an effluent containing manganous ions;

(e) separating the effluent containing manganous ions from the pulp slurry with a non-alkaline wash and recycling the effluent to step (a); and then (f) extracting the oxidized lignins from the pulp slurry with from about 1% to about 10% sodium hydroxide, by weight of oven-dried pulp, at from about 20° C. to about 100° C., for about 10 minutes to about 180 minutes, at a pulp consistency of from about 3% to about 20%.

* * * * *